US007415767B2

(12) United States Patent
Saker et al.

(10) Patent No.: US 7,415,767 B2
(45) Date of Patent: Aug. 26, 2008

(54) SAFETY RAZORS

(75) Inventors: Ian Saker, Reading (GB); Joseph Roger Yeoman, Berkshire (GB)

(73) Assignee: The Gillette Company, Boston, MA (US)

( * ) Notice: Subject to any disclaimer, the term of this patent is extended or adjusted under 35 U.S.C. 154(b) by 308 days.

(21) Appl. No.: 11/203,366

(22) Filed: Aug. 12, 2005

(65) Prior Publication Data

US 2006/0032053 A1 Feb. 16, 2006

(30) Foreign Application Priority Data

Feb. 19, 2003 (GB) ..... 0303871.8

(51) Int. Cl.
*B26B 19/00* (2006.01)

(52) U.S. Cl. ..... 30/34.05; 30/41; 30/50

(58) Field of Classification Search ..... 30/34.05, 30/41

See application file for complete search history.

(56) References Cited

U.S. PATENT DOCUMENTS 5,046,104 A 9/1991 Kloss
5,463,598 A * 10/1995 Holland et al. ..... 367/131
5,649,556 A 7/1997 Braun
5,956,851 A * 9/1999 Apprille et al. ..... 30/47
6,102,055 A 8/2000 Karnatz
6,189,215 B1 2/2001 Beerwerth et al.
6,199,239 B1 * 3/2001 Dickerson ..... 15/105
6,460,251 B1 * 10/2002 Orloff ..... 30/41.7
6,481,104 B1 11/2002 Parker et al.
6,898,292 B2 * 5/2005 Tanabe et al. ..... 381/191
2002/0189102 A1 12/2002 Orloff

FOREIGN PATENT DOCUMENTS

| | | |
|---|---|---|
| CA | 2 261 320 A | 8/2000 |
| DE | A-3122521 | 6/1981 |
| GB | A-2377995 | 1/2003 |
| JP | A-9051740 | 2/1997 |

* cited by examiner

*Primary Examiner*—Kenneth E. Peterson
*Assistant Examiner*—Sean Michalski
(74) *Attorney, Agent, or Firm*—Brion A. Berman; Kevin C. Johnson

(57) ABSTRACT

The invention relates to safety razors having a blade unit carried on a handle that includes a vibration mechanism and a control device for controlling operation of the vibration mechanism, the control device being connected to an electrode arrangement that can comprise a blade and an electrically conductive casing of the handle, to detect water so that the vibration mechanism is activated in response to the blade unit being immersed into a body of water for rinsing.

12 Claims, 9 Drawing Sheets

SAFETY RAZORS

CROSS REFERENCE TO RELATED APPLICATIONS

This application claims the benefit of priority under 35 U.S.C. § 120 from WO 2004/073940 A1, filed on Feb. 19, 2004, which claims priority from GB 0303871.8, filed on Feb. 19, 2003, the contents of both of which are incorporated herein by reference in their entirety.

TECHNICAL FIELD

This invention relates to safety razors.

BACKGROUND

A safety razor generally comprises a handle and a blade unit carried on the handle and including at least one blade with a sharp cutting edge. In the course of shaving, the blade unit is applied against the skin and the blade or blades are moved across the skin so that the sharp cutting edges engage and cut through the hairs protruding from the skin. The blade unit can be fixed on the handle with the intention that the entire razor should be discarded when the cutting edges have become dull and are no longer capable of providing a comfortable shave. Alternatively, the blade unit may be removably mounted on the handle so that the blade unit can be replaced by a new blade unit when the sharpness of the blades has diminished to an unacceptable level. Replaceable blade units are often referred to as shaving cartridges.

It is known to include electrically operated vibration mechanisms in safety razors, e.g., as disclosed in EP-A-0885698, U.S. Pat. Nos. 6,481,104 B1, and 5,046,249. Other forms of electrical device can also be provided in a safety razor and U.S. Publication No. 2002/0189102 describes a razor including force sensors and an indicator to signal when the blades need to be replaced.

The prior art also includes proposals to include water detectors in association with electrical equipment, for example to detect leaks from domestic appliances as taught by GB-A-2377995, to prevent operation of a coffee maker when the water tank is empty as disclosed in DE-A-3122521, or to switch of a heater when the water level in a fish tank is low as described in JP-A-9051740.

For a long time it has been known that safety razors are advantageously constructed to facilitate cleaning, that is the removal of shaving debris and soap which tend to collect on the blade unit, by rinsing in water. In more recent times it has become appreciated that effective rinsing plays an even more important role than previously recognised and makes a significant contribution to overall razor performance.

SUMMARY OF THE INVENTION

The present invention has as an object to provide a razor with enhanced rinsing capability and in accordance with the invention there is provided a safety razor including a blade unit having at least one blade with a sharp cutting edge, a handle on which the blade unit is carried, an electrical device, and control device for controlling operation of the electrical device, the control device being responsive to a water detecting arrangement whereby the electrical device is actuated when a person using the razor immerses the blade unit into a body of water for cleaning the blade unit.

With a safety razor according to the invention an electrical device having a function to aid rinsing can be activated automatically when the blade unit is immersed in a body of water for washing shaving debris and soap from the blade unit. The electrical device can take different forms. For example, it can include an actuator that is operable to move one or more components of the blade unit, such as to increase clearances through which water can flow during rinsing. Alternatively, the electrical device can actuate a pump or jetting device to cause an increased flow of rinsing water through the blade unit. In a useful and particularly efficacious embodiment, the electrical device includes a vibration mechanism for vibrating the blade unit, or at least a component thereof, such as the blade or blades, when the device is activated on immersion of the blade unit into a body of water.

It is known that vibration can assist the cleaning of a safety razor. It is also known that vibrating the blade unit of a razor as it is moved across the skin surface can have a beneficial effect on the shaving performance of the razor. Many razor users, however, dislike the feel of a vibrating razor held in the hand and as a consequence razors that vibrate constantly when turned on have not proved to be as popular as might have been expected. With the present invention the vibration generating mechanism can be actuated automatically when the blade unit is immersed in water to assist the removal of shaving soap and debris collected on the blade unit, and the vibration can stop when the blade unit is lifted clear of the rinsing water. If desired, the vibration mechanism can be arranged so as to be actuated also when the blade unit is applied by the razor user against the skin to be shaved, but that is not essential according to the present invention.

It is not essential for the control device to act as an on/off switch and it could instead be arranged, for example, to change the frequency of vibration when the blade unit is immersed in water. A small amount of low frequency vibration before the blade unit is immersed in water may be desirable to provide the user with a tactile indication that the mechanism is operational. The frequency of vibration is not critical and vibration at ultrasonic frequencies as well as subsonic frequencies during rinsing is possible. If the vibration generating mechanism is also operated during actual shaving, the vibration frequency during rinsing may be either the same as or different than the vibration frequency during shaving. The vibration mechanism can incorporate a piezoelectric device for producing the vibrations. Alternatively an electric motor for rotationally driving an eccentric weight can be used to impart vibration to the blade unit. The vibration mechanism and a battery for providing electric power to the motor can be conveniently housed in the razor handle.

The water detecting arrangement conveniently includes a pair of electrodes, at least a first one of which is provided on the blade unit and which can be constituted by at least one blade of the blade unit. A separate electrode can, however, be provided on the blade unit if preferred. A second electrode can be carried by the handle and may be formed by a casing of the handle. The electrodes are spaced apart from each other so that, in normal use of the razor, the electrodes will not be bridged by shaving foam, or the like, and collected on the blade unit in the coarse of shaving. The blade unit can include a plastic frame, at least part of which may be made of conductive plastics to provide an electrode and/or or provide electrical connection to the electrode thereon. Electrical connection to the electrode can also be achieved by plating, coating, or printing an electrically conductive material onto the frame of the blade unit, or by equipping the blade unit with one or more conductive strips for this purpose.

In certain embodiments, the water detecting arrangement is sensitive to a change in an electrical parameter, such as the electrical resistance or the capacitance, between the electrodes. The second electrode can be formed at least in part by the razor handle, and in a particular construction the handle includes a gripping portion, and a neck extending from the gripping portion and to which the blade unit is attached, the second electrode including an electrically conductive probe located on the exterior of the neck and connected to an electrically conductive casing of the gripping portion.

The control device may include a signal generator arranged to generate a pair of electrical signals, and a comparator arranged to compare said pair of electrical signals and to provide an output indicative of a predetermined change in the relationship between the pair of signals, there being an output produced to actuate said electrical device, the predetermined change occurring when the electrodes are in contact with common body of water.

In a particular embodiment, the signal generator is an oscillator and the pair of electrical signals is a pair of oscillating signal. The first and second capacitances are arranged to be charged by the respective oscillating signals, and the electrodes are arranged such that the first capacitance is charged slower than the second capacitance when the blade unit is immersed into a body of water for cleaning the blade-unit, e.g., due to a further capacitance being coupled in parallel with said first capacitance.

The safety razor can include an electric power source, especially a battery, e.g., a rechargeable battery, to supply electric power for the control means and the electrical device, as well as a switch device arranged to connect or interrupt the supply of electric power from the electric power source to the control device and electrical device. The switch device can be on the exterior of the handle and manually operable by the user. Alternatively, it can be arranged to interact with an associated storage tray to interrupt the supply of electric power from the electric power source when the razor is inserted into the storage tray and to connect the supply when the razor is removed therefrom.

DESCRIPTION OF DRAWINGS

To facilitate a clear understanding of the invention, an embodiment is described in detail below with reference to the accompanying drawings, in which.

DETAILED DESCRIPTION

Figure 1:
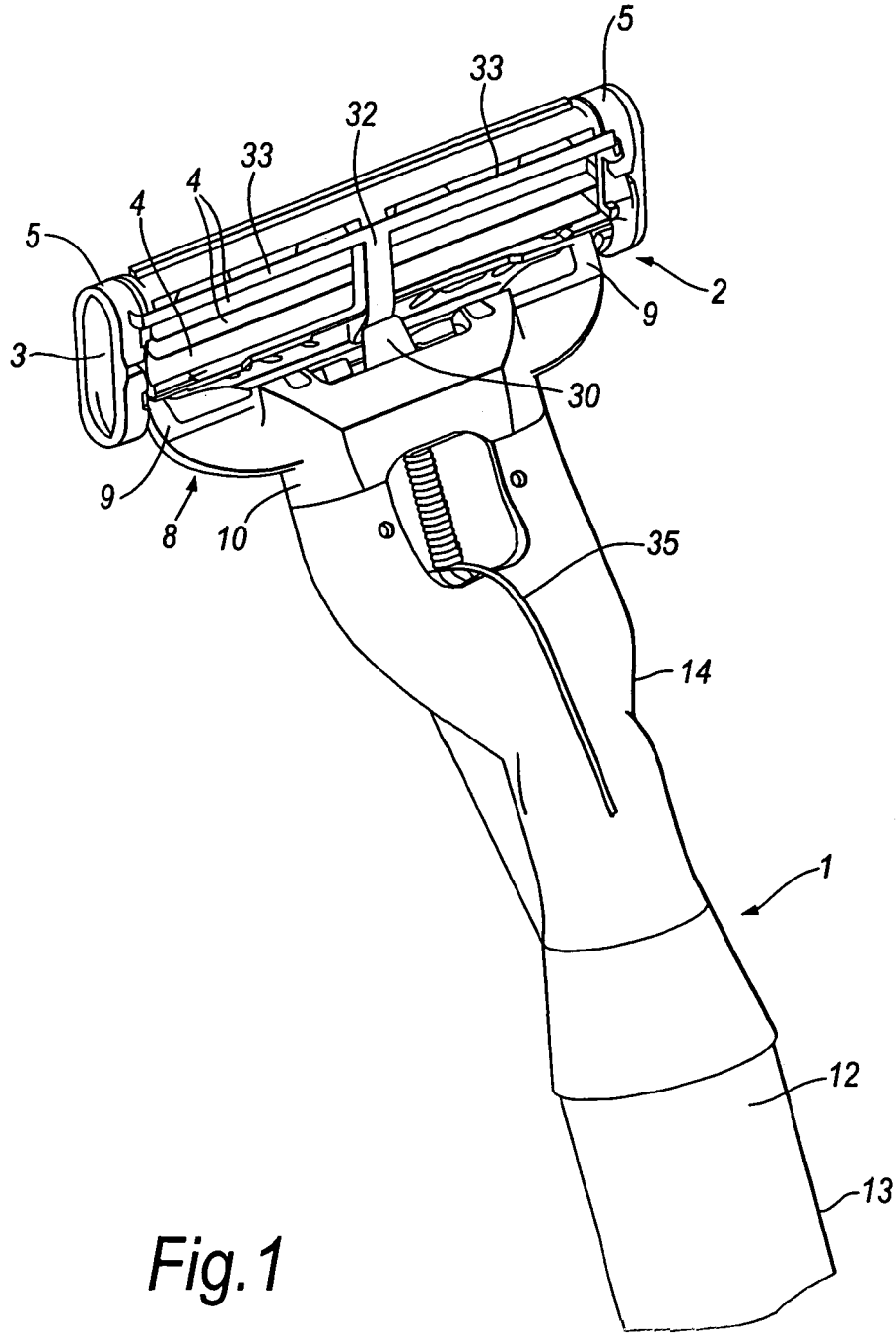
FIG. 1 is a partial isometric view of the razor illustrating the blade unit and an upper portion of the handle as seen from the rear.

The safety razor illustrated in the drawings has a handle 1 and a blade unit or cartridge 2 detachably mounted on the upper end of the handle. The blade unit 2 includes a generally rectangular frame 3, and a plurality of blades 4, e.g., 3, 4, or 5 blades, with substantially parallel sharp cutting edges, disposed in the frame and held in place by metal clips 5 positioned around the frame 3 at the opposite ends of the blade unit 2. A guard structure including a strip of elastomeric material is provided on the frame for contacting the skin in front of the blades, and a cap structure including a lubricating strip is provided on the frame for contacting the skin behind the blades during the performance of a shaving stroke. The frame is pivotally carried on a yoke member 8 having a pair of arms 9 which extend from a hub 10 and are journalled in opposite ends of the frame 2 so that the blade unit 2 can pivot relative to the handle 1 about an axis substantially parallel to the blade edges. The hub 10 is connected detachably to the end of the handle 1. As so far described the razor is of a known construction and for further details reference may be made to earlier patent publications, one example of which is WO 97/37819, the contents of which are incorporated herein by reference in their entirety.

The razor handle includes a main portion 12 intended to be gripped in the hand and a neck 14 extending upwardly from the main portion and to the free end of which the blade unit 2 is attached. The main or gripping portion 12 of the handle 1 includes an electrically conductive, e.g., metal, casing 13, which serves as an electrode for electrical contact with the hand of a user as described in more detail below. Housed within a battery compartment in the handle is a replaceable or rechargeable battery 15, which constitutes a power supply for an electronic control device 16 also accommodated within the handle. The battery 15 is electrically connected to the control device 16 through a power switch that is operable to interrupt power supply to the control device for conserving battery energy during periods when the razor is not being used. The power switch could be located on the handle for manual operation, but in some constructions the power switch is arranged to be actuated by removing the razor from, and returning it to, a razor holder on which the razor is intended to be stored when not in use.

Figure 3:
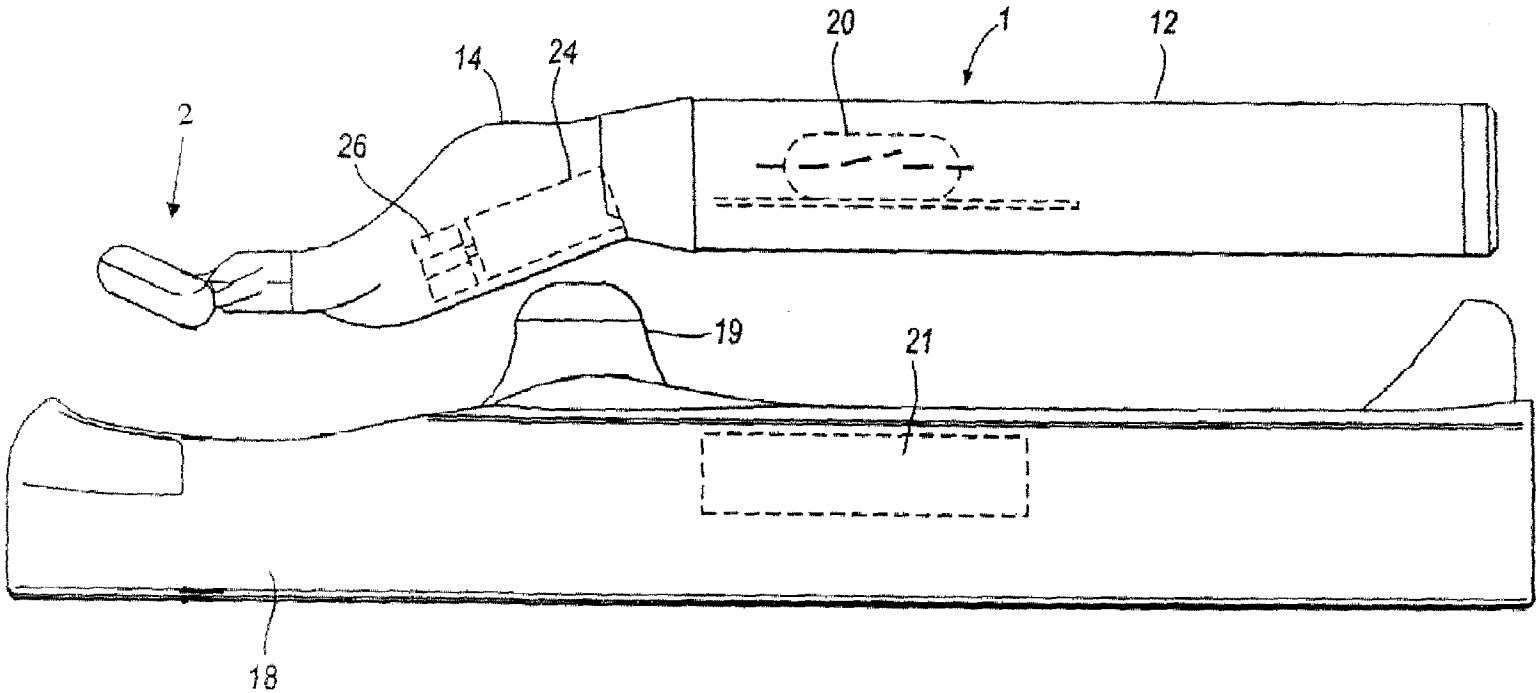
FIG. 3 is a side elevation showing a razor holder in the form of a tray on which the razor is stored during periods of non-use, the razor being shown separated from the storage tray at a small distance.
Figure 4:
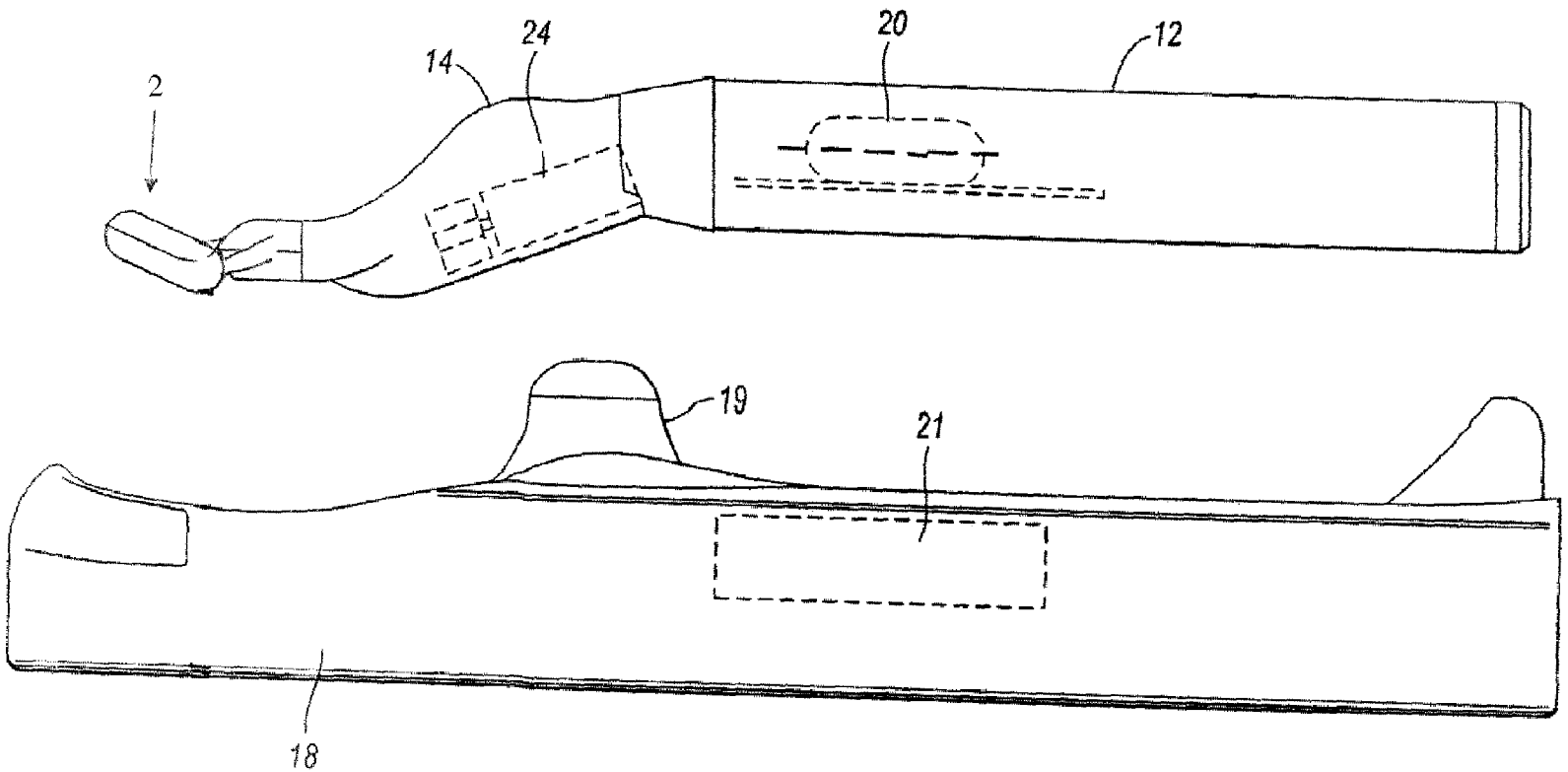
FIG. 4 is a side elevation corresponding to claim 3, but showing the razor at a greater distance form the storage tray.
Figure 5:
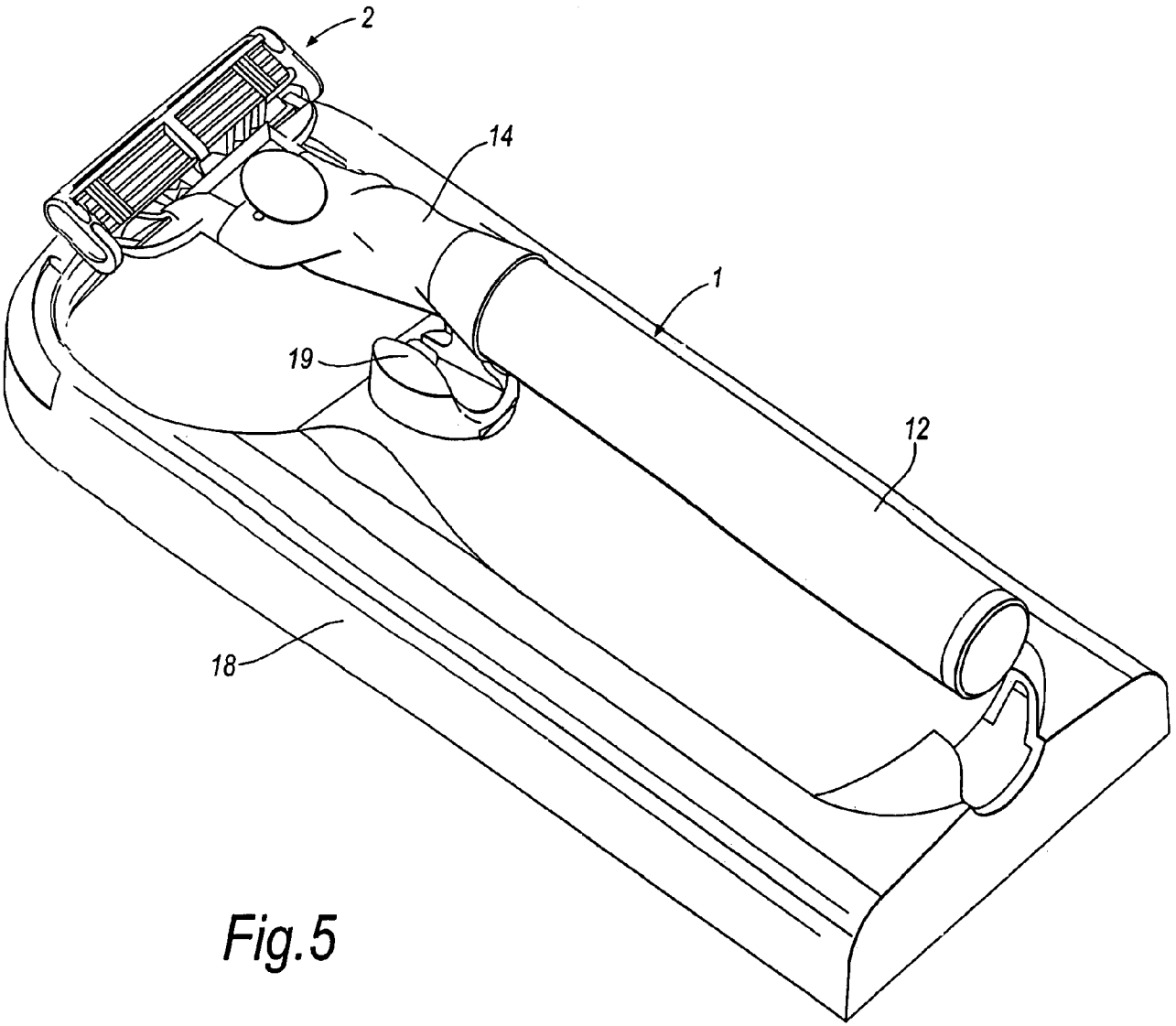
FIG. 5 shows the razor and storage tray of FIG. 3 in an isometric view.
Figure 6:
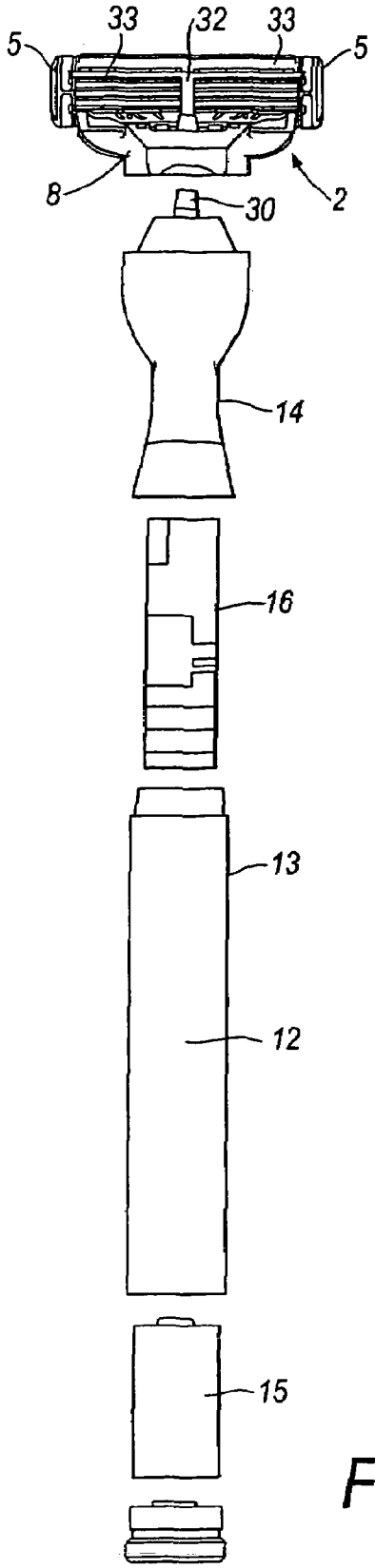
FIG. 6 is an exploded rear elevation of the razor.

A known form of razor holder consists of a tray 18 as shown in FIGS. 3-5, the tray 18 having on its upper side a saddle 19 adapted to receive and lightly grip the neck 14 of the razor handle 1. The razor handle 1 could be equipped with a mechanical switch so arranged for cooperation with the storage tray 18 that the switch is operated automatically when the razor is lifted away from the storage tray 18 for power to be supplied to the control device 16 from the battery 15, and to be actuated upon replacement of the razor on the tray to interrupt the power supply. In certain embodiments, essentially the same result is achieved by a power switch in the form of a reed switch 20 located within the handle 1, the storage tray 18, being provided with a permanent magnet 21. When the razor is positioned close to the tray 18 the reed switch 20 is held open and there is no electrical power supply from the battery 15, as shown in FIG. 3. When the razor is moved away from the tray the reed switch 20 closes and electrical power supply to the control device 16 is established.

Figure 2:
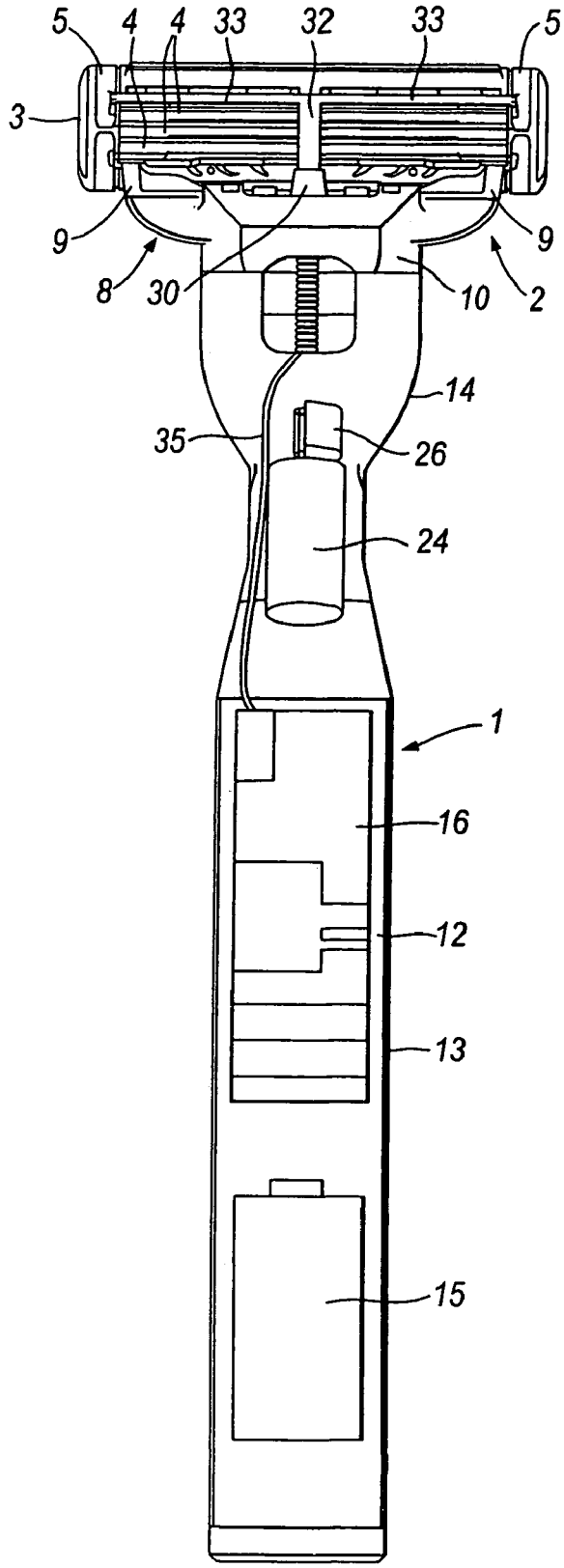
FIG. 2 shows the razor in rear elevation.

The control device 16, in a manner described in detail below, controls actuation of an electric motor 24 (FIGS. 2 and 3) housed within the handle 1 and having an output shaft with an eccentric weight 26 fastened thereon. In a manner known per se, energization of the electric motor results in a high speed rotation of the eccentric weight 26 and thereby vibration of the razor, and the blade unit 2 in particular. A suitable vibration frequency is around 120 Hz.

The blade unit 2 incorporates an electrode that is conveniently constituted by at least one or all of the blades 4 of the blade unit. Electrical connection between the control device and this electrode 4 is achieved by the neck 14 of the handle 1 having a contact 30 arranged to project through the hub 10 of the yoke member 8 and to bear against a contact strip 32 fixed to the rear of the blade unit 2. The contact strip 32 can have lateral wings 33 which extends to and are conductively connected to the metal blade retention clips 5, and these clips in turn having contact with blades 4. Of course, it is not essential to use the blades 4 as an electrode and a separate electrically conductive element could be provided on the blade unit in a position for contacting the skin when the blade unit 2 performs a shaving stroke. The contact 30 makes constant electrical contact with the contact strip 32 so that the electrical continuity between the electrode at the blade unit is not interrupted even during pivoting of the blade unit 2 on the handle 1 as tends to occur as the blade unit is applied to and moved across the skin. The contact 30 conveniently takes the form of a spring-loaded plunger for resisting pivotal movement of the blade unit away from a predetermined rest position. The contact 30 is shown connected electrically to the control device 16 by a wire conductor 35 which is led through the neck 14 of the handle 1.

Of course, there are other possibilities to ensure electrical connection of the electrode on the blade unit and the control device. For example, the frame 3 of the blade unit could be made of an electrically conductive material, such as a conductive plastics. Also the rear of the frame 3 could be plated, coated, or printed with conductive material, have an adhesive metal foil applied to it, or have a metal element embedded therein to provide electrical connection between the contact 30 and the clips 5, or to the electrode itself or another component in contact with the electrode. Alternatively, the frame can include an injection molded metal part to provide the conductive path between the electrode and the contact 30, or water held in capillary grooves may be sufficient to ensure the electrical continuity.

Figure 7:
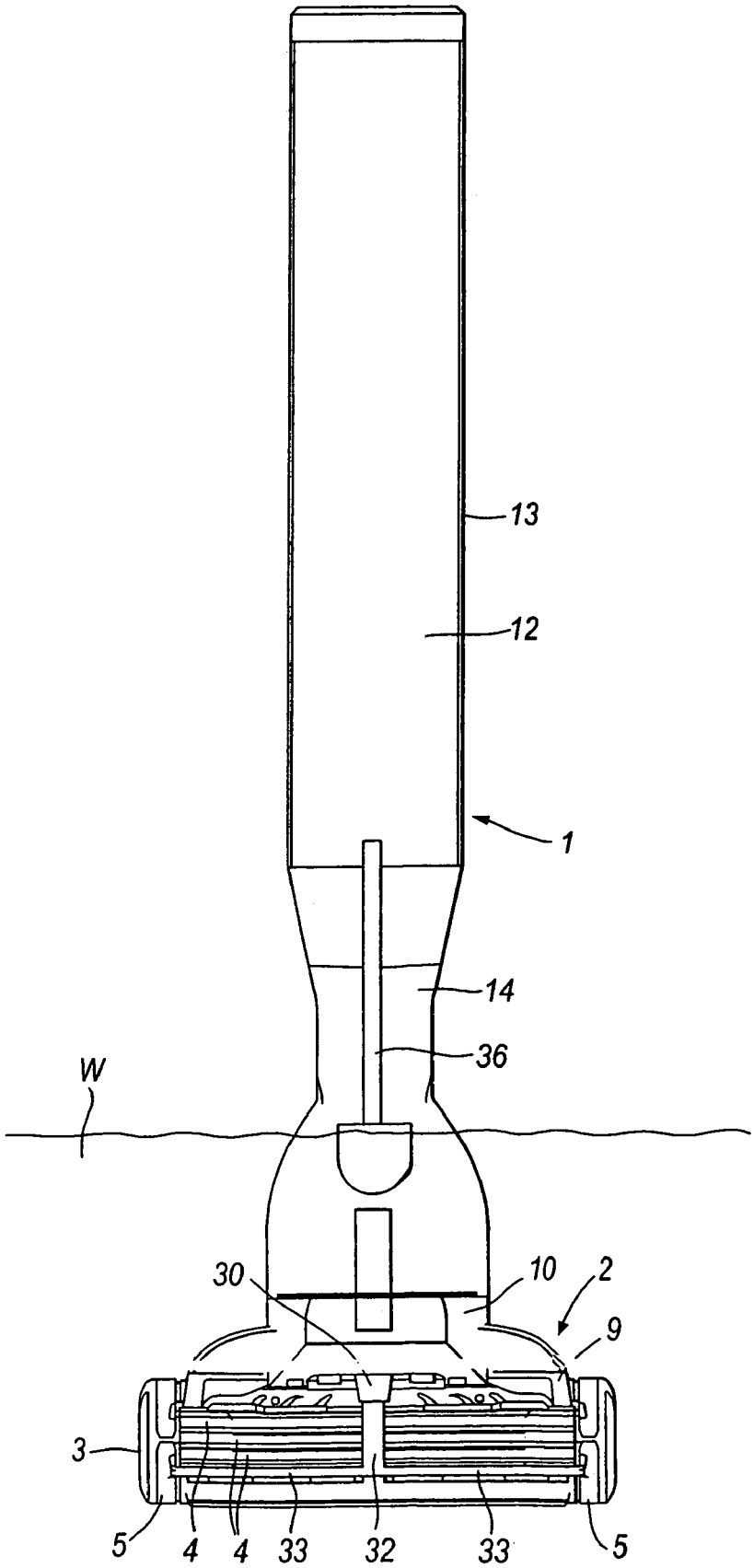
FIG. 7 is a rear elevation of the razor illustrating an additional element of the water detecting arrangement.

It is possible for the control device 16 to be arranged to determine when the blade unit is immersed in water by sensing an electrical parameter between the electrode 4 on the blade unit 2 and the electrode formed by the metal casing 13 of the handle gripping portion 12. It is not necessarily essential for the blade unit 2 to be plunged into water so deeply that the water must contact the handle gripping portion 12 for the immersion of the blade unit into the water to be detected, as may be the case if it is known the body of water will be connected to earth and the casing of the gripping portion handle will also be connected to earth, such as by the razor user. As illustrated in FIG. 7, however, the razor includes a water detection probe 36 which extends along the exterior of the neck 14 of the handle. The probe 36 is electrically conductive and serves as an electrode, or an electrode extension in as much that it can be electrically connected to the metal casing 13 of the handle gripping portion 12. A separate electrical connection between the probe 36 and the control device 16 can alternatively be used.

The control device 16 senses an electrical parameter, which may be electrical resistance or capacitance, between the blade electrode 4 and the probe electrode 36, and is responsive thereto to actuate the electric motor 24 to activate the vibration generator 26 when the blade unit 2 is immersed into a body of water W so that both electrodes make contact with the water. The control device operates to turn off the power supply to the motor 24 when the blade unit 2 is lifted out of the water W. The operation of the control device 16 is described in detail below.

In certain embodiments of the invention, the control device 16 also functions as a touch sensitive device so that the motor 24 is actuated to drive the vibration generating eccentric weight 26 when a person holding the razor by the handle touches the blade unit 2 against the skin surface, e.g., at the start of a shaving stroke. Vibrating the blade unit as it moves across the skin can have a beneficial effect on the shaving performance. However, as soon as the blade unit is lifted away from the skin surface the vibration stops. It has been found that the discomfort perceived by users of vibrating razors applies for the most part only when the razor is held with the blade unit away from the body in free space and by the vibration occurring only when the razor is actually shaving and during rinsing of the blade unit, the user prejudices against vibrating razors are mostly eliminated.

Figure 8:
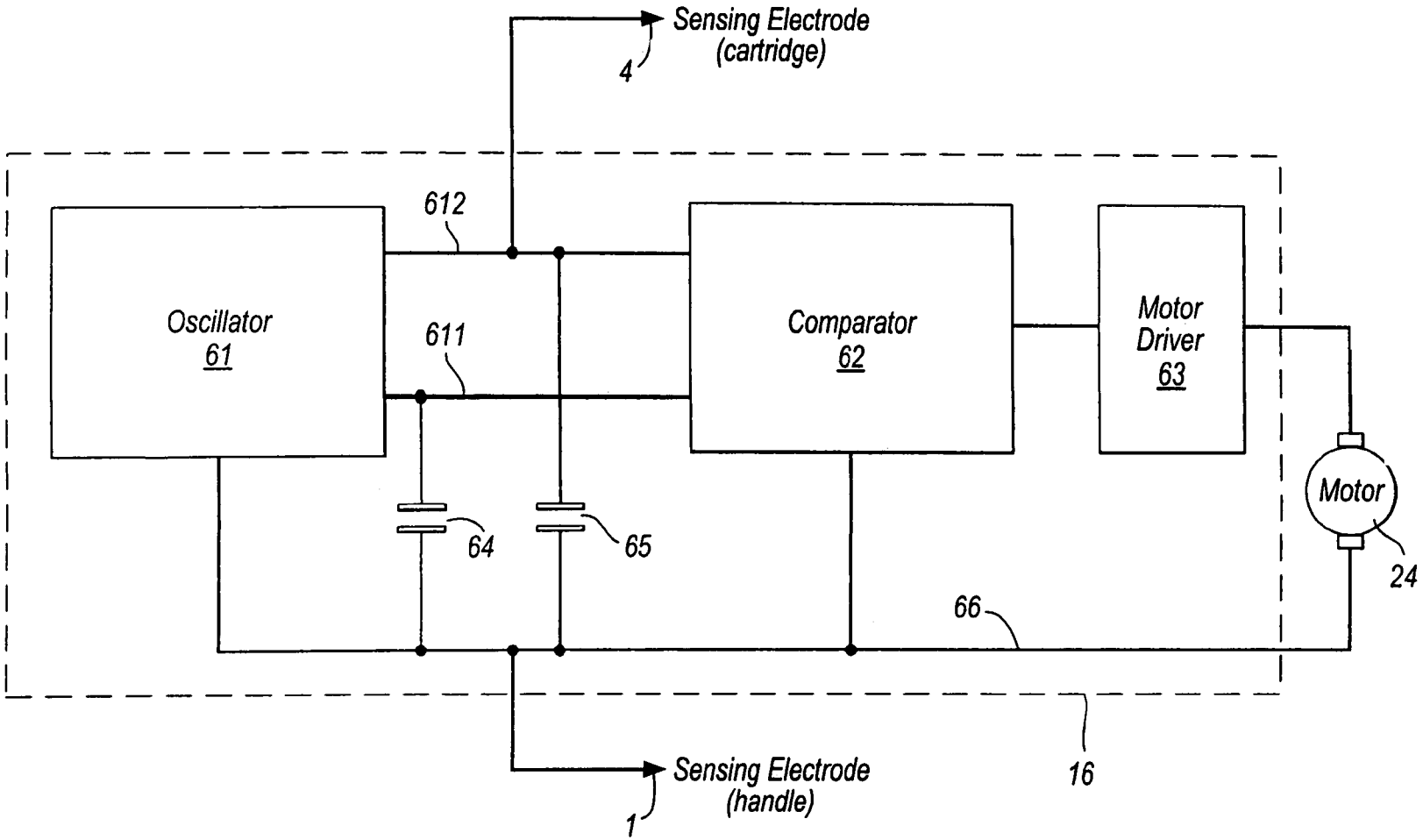
FIG. 8 is a block diagram of an electronic control device incorporated in the razor.

FIG. 8 is a schematic diagram to illustrate the function of control device 16. As shown, control device 16 includes an oscillator 61, a comparator 62, motor driving circuitry 63, and first and second capacitors 64, 65. Control device 16 is additionally connected to two sensing electrodes constituted as described above. Motor driving circuitry 63 is connected to provide the drive current to motor 24. As mentioned above, the power necessary to energize control device 16 is provided by battery 15 through a power switch. The power connections are omitted from FIG. 8 for clarity, it being understood that the following description of the operation of control device 16 is applicable to the condition when it is energized by the application of power from the battery.

Oscillator 61 is configured to provide two oscillating signals on output lines 611 and 612 respectively. Output lines 611 and 612 are connected to line 66, which serves as a ground line for the circuitry, via first and second capacitors 64, 65, respectively. Lines 611 and 612 further provide a pair of inputs to comparator 62. In essence, the comparator 62 is sensitive to changes in the relationship between its two inputs. The sensor electrodes are connected such that the relationship between the two inputs to the comparator changes when the electrical condition between the electrodes changes. Being sensitive to such a change, the comparator switches the motor driver circuitry 63 on.

In more detail, it will be seen in FIG. 8 that line 612 is additionally connected to one of the sensing electrodes. When there is no effective electrical connection between the two electrodes, the signals output by oscillator 61 on lines 611 and 612 have a first predetermined relationship at the input to comparator 62. When the sensing electrodes are brought into contact, for instance by rinsing as mentioned above, some additional electrical connection is made between line 612 and ground line 66. This may include for instance capacitance additional to capacitor 65 and/or electrical resistance. In any event the additional connection is effective to alter the characteristics of the signal on line 612 input to comparator 62. Accordingly, the relationship between the two inputs change and the comparator 62 responds by activating motor driving circuitry 63, and thus motor 24.

As described above, control device 16 is responsive to both of the sensing electrodes being in contact with water depending upon the construction or the operating conditions of the device or the sensitivity of the comparator, control device 16 may also be responsive to other conditions. In particular, if a user is holding the shaving device and is thereby in contact with one of the electrodes, it may be sufficient to bring the other electrode into contact with rinsing water if the user and the water provide sufficient connection to a common point, for instance earth. Further, the other electrode may be arranged to be close to or touching the body of the user when the shaver is in use. The contact with or proximity of the other electrode to the body is sufficient in this case for an additional capacitance to appear between lines 612 and 66 and so cause the above described change in the signals on line 612. The sensitivity of the comparator or other circuit proximity can be set to determine the approximate distance from the body at which this effect will occur. This may for instance be set to be approximately 10 mm.

In various embodiments within this invention, variations on the arrangement of FIG. 8 are possible. As mentioned above, the invention may be configured to activate some device other than the motor 24 as well as or instead of the motor. In such a case motor driving circuitry would be replaced or supplemented by circuitry suitable for providing the current required by such other device.

Further, control means 16 may be arranged to provide some form of output whenever it is energized by the power switch 20 connecting the battery power to the control means. Control means 16 may be provided with a secondary input to the motor driving circuitry 63 such that the motor is driven to provide a low level vibration the control means is immediately energized, which alters to a greater level of vibration upon sensing as described above. A lighting device may be provided as part of the hand held device arranged to be lit whenever the power switch is "on." This or a further lighting device may be arranged to flash when battery power is low.

Figure 9:
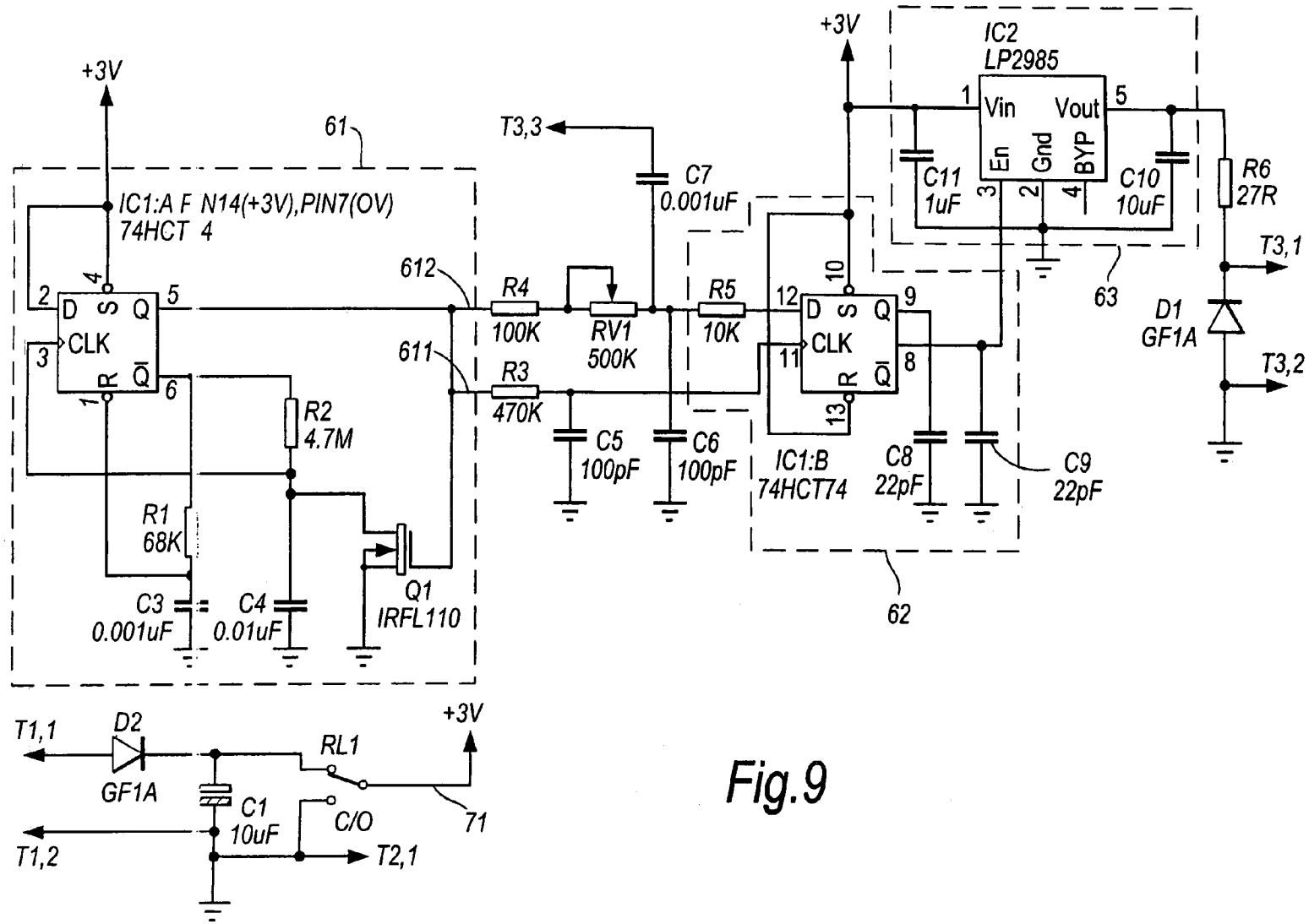
FIG. 9 shows an example of a specific embodiment of a control circuit.

FIG. 9 illustrates a circuit implementation of the control device 16 of FIG. 8. This is shown merely by way of illustration and many other ways of implementing the functionality of the control device 16 are possible. In FIG. 9, IC1:A, IC1:B and IC1:C are integrated circuit devices and other components are resistors, capacitors, diodes, and transistors designated by the prefixes R, C, D, and Q with exemplary values being shown in the Figure.

In FIG. 9, RL1 is the power switch 20 described earlier and is a reed switch operated by a magnet 21 in the tray 18 designed to hold the razor when not in use. When the razor is removed from the tray, the switch RL1 is in the position illustrated such that the power from battery 15 connected to terminals T1, 1 and T1, 2 is applied to the circuit via the +3V rail, 71. Terminal T2,1 is connected to one of the two electrodes described above and also provides the "ground" for the circuit. In embodiments where it is desired to have one of the electrodes in contact with a user during use, this ground electrode would be connected to the exterior of the handle of the razor.

IC1:A forms the heart of the oscillator 61 and is configured with associated resistors R1, R2, capacitors C3, C4, and transistor Q1 to provide an oscillation output on lines 611 and 612. These provide the inputs to comparator 62, at the heart of which IC1:B, via resistor and capacitor networks R4, RV1 and C6, and R3, and C5.

Within each cycle of the oscillating signal, when the signal on line 611 goes high, capacitor C5 starts to charge via resistor R3. Therefore, a rising signal is applied to the clock input of IC1:B. At a certain level of this input signal, the clock input of IC1:B changes from low to high. The frequency of the oscillation and the charging rate of capacitor C5 are set such that the "high" clock input to IC1:B is reached during each oscillator cycle. As is well known whenever the clock signal goes high, the value of the 'D' input to IC1:B is clocked through to the Q output, with Q being the inverse.

Also within each cycle of the oscillating signal, when the signal on line 612 goes high, capacitor C6 starts to charge via resistor R4 and variable resistor RV1. As capacitor C6 has the same value as capacitor C5, when nothing is connected to terminal T3,3 and RV1 is set so that the combination of R4 and RV1 is equivalent to R3, the charging rate of the two capacitors is the same. Therefore RV1 can be used to trim the circuit to ensure that, in this condition, C6 charges at least as quickly as C5 such the when the clock input to IC1:B goes high, the 'D' input from line 612 is also high. In this condition Q is always low and the motor driving circuitry 63 is not enabled.

Terminal T3,3 is connected to the other electrode of the device, typically the electrode 4 in the blade unit of the razor. Accordingly, when some form of electrical connection is made between the electrodes as described above, for instance by the electrodes being brought into contact with a body of water, an additional path to ground is made, via a capacitor C7 and whatever resistance and capacitance the water has. This has the effect of slowing the charging rate of capacitor C6 such that, when the clock input of IC1:B goes high, the 'D' input is still low and so Q goes high.

Motor 24 is connected to terminals T3,1 and T3,2 and is driven by standard motor driven circuit IC2. This circuit is enabled by the value of Q of IC1:B going high, thereby activating the motor 24.

As described about the control device functions so that the motor 24 stops immediately when the blade unit of the razor is moved out of contact with the skin. This is not essential and the control device can be arranged to provide a short delay of up to a few seconds, e.g. around 0.1 to 0.5 seconds, before turning off the power supply to the motor after contact between the blade unit and the skin of the user is interrupted, which may be beneficial in maintaining the vibration of the razor between shaving strokes performed in quick succession.

It should be understood that the foregoing description is given by way of non-limiting example only and that modifications are possible without departing from the scope of the invention as defined by the claims which follow. As an example of one possible modification, the conductive casing 13 of the handle could be provided with a thin covering layer of insulating material so that there is a high capacitance and high resistance coupling between the hand of the user and the handle electrode. Furthermore, a manually operable switch mechanism can be included on the razor handle and be connected electrically in series with the switch 20, for use by a user who prefers not to use the storage tray 18 for holding the razor when it is not being used. This switch, or a different manually operable switch, such as an electronic toggle switch that turns on and/or off after a certain delay, may be included to allow the razor user to select a non-vibrating mode, for example when trimming hair in awkward areas.

OTHER EMBODIMENTS

A number of embodiments of the invention have been described. Nevertheless, it will be understood that various modifications may be made without departing from the spirit and scope of the invention.

What is claimed is:

1. A safety razor comprising;

a blade unit having at least one blade with a sharp cutting edge;

a handle on which the blade unit is carried;

an electrical device: and a control device for controlling operation of the electrical device, wherein the control device is responsive to a water contacting detecting arrangement whereby the electrical device is actuated when a person using the razor immerses the blade unit into a body of water for cleaning the blade unit, wherein the water contacting detecting arrangement comprises an electrode on the blade unit, wherein the water contacting detecting arrangement comprises a second electrode and the control device is sensitive to a differential in an electrical parameter between the electrodes.

2. A safety razor of claim 1, wherein the second electrode is arranged to be in contact with the water.

3. A safety razor of claim 1, wherein at least part of the second electrode comprises a part of the handle.

4. A safety razor of claim 1, wherein the electrical parameter is electrical resistance.

5. A safety razor of claim 1, wherein the electrical parameter is electrical capacitance.

6. A safety razor of claim 1, wherein the handle comprises a gripping portion, and a neck extending from the gripping portion and to which the blade unit is attached, and wherein the second electrode comprises an electrically conductive probe located on the exterior of the neck.

7. A safety razor of claim 6, wherein the gripping portion comprises an electrically conductive casing to which the probe is electrically connected.

8. A safety razor of claim 1, wherein said control device comprises a signal generator ranged to generate a pair of electrical signals, and a comparator arranged to compare said pair of electrical signals.

9. A safety razor of claim 8, wherein said signal generator comprise an oscillator and said pair of electrical signals comprises a pair of oscillating signals.

10. A safety razor of claim 9, wherein said control device comprises first and second capacitances respectively arranged to be charged by said pair of oscillating signals, wherein said electrodes are arranged such that the first capacitance is charged more slowly than the second capacitance when the blade unit is immersed into a body of water for cleaning the blade unit.

11. A safety razor of claim 10, wherein said first and second electrodes are arranged to couple a further capacitance in parallel with said first capacitance when the blade unit is immersed into a body of water for cleaning the blade unit.

12. A safety razor of claim 1, further comprising an electric power source arranged to supply electric power for said control device and said electrical device.

* * * * *